US008597068B1

(12) United States Patent
Stathis

(10) Patent No.: US 8,597,068 B1
(45) Date of Patent: Dec. 3, 2013

(54) SAFE SPINNING BUTTON NECKLACE TOY

(76) Inventor: Eileen Stathis, Belle Harbor, NY (US)

( * ) Notice: Subject to any disclaimer, the term of this patent is extended or adjusted under 35 U.S.C. 154(b) by 443 days.

(21) Appl. No.: 12/960,959

(22) Filed: Dec. 6, 2010

(51) Int. Cl.
*A63H 1/32* (2006.01)
*A63H 33/00* (2006.01)

(52) U.S. Cl.
USPC ..... 446/253; 446/27

(58) Field of Classification Search
USPC ..... 446/26, 27, 71, 236, 253; 63/1.11
See application file for complete search history.

(56) References Cited

U.S. PATENT DOCUMENTS

| | | | | | |
|---|---|---|---|---|---|
| 1,803,638 | A | | 5/1931 | Nudelman | |
| 2,226,195 | A | | 12/1940 | Buben | |
| 2,330,538 | A | * | 9/1943 | Allen | 446/227 |
| 2,739,419 | A | | 3/1956 | Cleveland | |
| 3,516,195 | A | | 6/1970 | Batley | |
| 3,745,694 | A | * | 7/1973 | Vennola | 446/102 |
| 3,850,429 | A | * | 11/1974 | Clifford | 482/122 |
| 4,003,575 | A | * | 1/1977 | Hobbs | 473/576 |
| 4,232,475 | A | * | 11/1980 | Bauer | 446/214 |
| D302,192 | S | | 7/1989 | Ansah | |
| 4,911,447 | A | * | 3/1990 | Pickard | 273/141 R |
| 4,986,790 | A | * | 1/1991 | Boury | 446/253 |
| D320,827 | S | | 10/1991 | Centafanti | |
| D333,849 | S | | 3/1993 | Gardner et al. | |
| 5,399,136 | A | * | 3/1995 | Bart | 482/110 |
| 5,440,900 | A | | 8/1995 | White | |
| 5,620,352 | A | * | 4/1997 | Tzong | 446/120 |
| 5,938,499 | A | | 8/1999 | Chen | |
| 5,979,184 | A | * | 11/1999 | Razza | 63/1.11 |
| 6,033,283 | A | * | 3/2000 | Chen | 446/253 |
| 6,120,342 | A | * | 9/2000 | Chan | 446/254 |
| 6,256,793 | B1 | * | 7/2001 | Arias et al. | 2/207 |
| 6,776,680 | B2 | * | 8/2004 | Chow | 446/247 |
| 6,802,758 | B2 | | 10/2004 | Somers | |
| 7,293,429 | B1 | * | 11/2007 | Reichert | 63/5.1 |
| 2008/0003917 | A1 | * | 1/2008 | Norman | 446/97 |
| 2010/0221975 | A1 | * | 9/2010 | Kimbrough | 446/99 |

FOREIGN PATENT DOCUMENTS

CA 2330817 A1 * 6/2002

* cited by examiner

*Primary Examiner* — Gene Kim
*Assistant Examiner* — Alyssa Hylinski
(74) *Attorney, Agent, or Firm* — Goldstein Law Offices, P.C.

(57) ABSTRACT

A safe spinning button necklace toy having a knotless string loop, a rotatable button spinner disposed on the string loop and a pair of protective casings covering the string loop that eliminates a strangulation hazard without interfering with the operation of the toy. The protective casing covers a pair of strands of the string loop, keeping the strands together inside the casing and preventing the strands from separating and creating a hazard. The casing substantially covers two-thirds of the string loop and prevents the strands separating without knotting the strands, allowing the string loop to freely twist when the button spinner is rotated. The casing has a plurality of links covering the string loop providing amusing noises by reverberating when the spinning button spins. A pair of handles on the string loop can be safely fastened together to close the necklace when the toy is not in use.

1 Claim, 4 Drawing Sheets

SAFE SPINNING BUTTON NECKLACE TOY

CROSS-REFERENCE TO RELATED APPLICATIONS

Not applicable.

BACKGROUND OF THE INVENTION

The invention relates generally to a spinning button necklace toy. More particularly, the invention relates to a safe spinning button necklace toy with a knotless string loop and a protective casing that eliminates a strangulation hazard but does not interfere with the operation of the toy.

One of the oldest toys known is a button spinner. Archeologists have even found an ancient version of the toy, a piece of bone tied with a strip of hide. Often a grandparent will use an odd button and string to make the button spinner to amuse a restless child, passing the tradition of the toy from generation to generation. Many a child remembers a button or token and a string as the primary spinning toy of their youth.

Button spinners are simple toys that even a young child with limited small motor skills can enjoy. To build a button spinner, a string or heavy thread is looped through two opposing holes of the button, and the ends tied together. The button is spun around until the strings are completely twisted on both sides. The strings are pulled taut causing the button to spin. The button will spin rapidly as the string unwinds. The angular momentum of the button will cause the strings to twist again in the opposite direction.

Parents today are vigilant about the toys their young children play owing to the fact that so many toys having been recalled as choking and strangulation hazards. The traditional button spinner with the exposed strings poses a strangulation hazard to young children, similar to venetian blind loop cords. The button moves freely along the string and moving the button to one side of the string and separating the strings creates a large opening that a child can place over his or her head. If the button is caught or pulled, the string tightens around the child's neck, choking the child.

Numerous modifications in the shape and configuration of the button spinner to produce different patterns when it spins or different sounds have been proposed. Some have placed holes with reeds to make whistling noises, or metal balls in a hollow in the spinner to make rattling noises. Some have added lights to the spinner or a second spinner. Many have added handles knotted to the string to make use easier. None of these modifications have been proposed to make the toy safer.

Others have developed different ways to use the toy beyond creating a delightful pattern of spinning and noise making. One modification turns the spinner into a weapon for combat play and other turns the spinner into a wheel for choosing a random result. None of these proposed modifications decreases the strangulation hazard.

One has suggested that a pair of knots, each halfway between the end of the string and the button spinner would make the toy safer, but knots in the strings change the twisting pattern of the string whether the knot is adjacent to the handle or disposed somewhere on the length of the string.

While these units may be suitable for the particular purpose employed, or for general use, they would not be as suitable for the purposes of the present invention as disclosed hereafter.

SUMMARY OF THE INVENTION

It is an object of the invention to produce a spinning button necklace toy that provides more amusing noises when the button spins. Accordingly, the spinning button necklace toy has a casing of a plurality of links covering a string loop that provide amusing noises by reverberating when the spinning button spins.

It is another object of the invention to produce a spinning button necklace toy that can be worn as a necklace when not in use. Accordingly, the spinning button necklace toy has a pair of handles on the string loop that can be safely fastened, a first handle fastening to a second handle to close the necklace.

It is a further object of the invention to produce a spinning button necklace toy that prevents a pair of strands of a string loop from separating, forming a strangulation hazard. Accordingly, the spinning button necklace toy has a protective casing covering the pair of strands of the string loop from separating by covering substantially two-thirds of the pair of strands, keeping the pair of strands together inside the casing.

It is yet another object of the invention to produce a spinning button necklace toy that prevents a pair of strands of a string loop from separating without knotting the strands together. Accordingly, the spinning button necklace toy has a protective casing that prevents the pair of strands of a string loop from separating by covering substantially two-thirds of the strands, keeping the pair of strands together inside the casing without knotting.

The invention is a safe spinning button necklace toy having a knotless string loop, a rotatable button spinner disposed on the string loop and a pair of protective casings covering the string loop that eliminates a strangulation hazard without interfering with the operation of the toy. The protective casing covers a pair of strands of the string loop, keeping the strands together inside the casing and preventing the strands from separating and creating a hazard. The casing substantially covers two-thirds of the string loop and prevents the strands separating without knotting the strands, allowing the string loop to freely twist when the button spinner is rotated. The casing has a plurality of links covering the string loop providing amusing noises by reverberating when the spinning button spins. A pair of handles on the string loop can be safely fastened together to close the necklace when the toy is not in use.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2A:
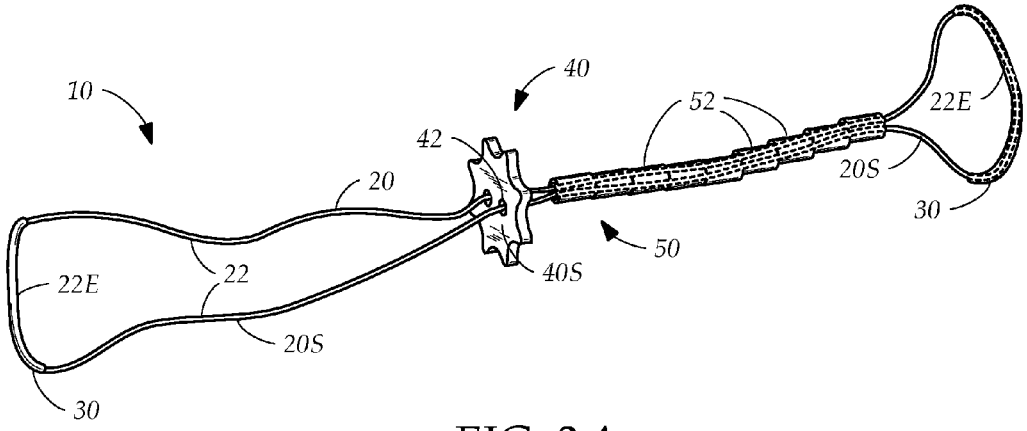
FIG. 2A is a diagrammatic perspective view of the spinning button necklace toy shown with a string loop shown in outline inside a cylinder link casing and a handle on a first side and without the casing on a second side.

FIG. 2A illustrates a spinning button necklace toy 10 constructed from a pair of equal length strands 22 of string creating a closed string loop 20 with a midpoint forming a pair of portions 20S, a protective casing 50 on a portion 20S, a pair of handles 30 on the portions 20S, and a button spinner 40 disposed on the string loop 20. A first portion 20S of the string loop 20 is shown in outline, the string loop 20 threaded through the protective casing 50 and a first handle 30. A user grasps the handles 30, holding the spinning button necklace toy 10 horizontally and rotates the button spinner 40 around to wind the string loop 20 tightly, creating tension. The user then moves the handles 30 alternatively toward and away from each other, causing the button spinner to spin 40 and the string loop 20 to alternatively wind and unwind until the tension is released.

The string loop 20 is a closed loop, created by the pair of strands 22 having a pair of ends 22E, a first end of a first strand connecting to a first end of second strand, a second end of the first strand connecting to a second end of the second strand. The button spinner 40 is a planar disk, having a pair of planar sides 40S and having a shape with a center, and having a pair of holes 42 substantially located equidistant from and adjacent to the center of the disk. The shape of the planar disk 40S is not limited to a circle, but can be, for example, but not limited to, a star, a sunburst, a football and other variations without limit. The button spinner 40 is rotatably disposed on the midpoint of the string loop 20 by a first strand 22 of the string loop 22 passing through a first hole 42 of the spinner 40 and a second strand 22 of the loop 20 passing through a second hole 42 of the spinner 40. The spinner 40 is disposed on the loop 20 such that a substantially equal portion of the string loop 20 is on each planar side 40S of the button spinner 40.

In FIG. 2A, a first portion 20S of the loop 20 is covered by the protective casing 50 formed by a plurality of links 52, enclosing the strands 22. In this illustration, the links are hollow cylinders with a thru bore, each having a long side and long axis parallel with the long side. The strands 22 of the string loop 20 extend fully through the bore such that each casing 50 substantially covers two-thirds of the first portion 20S, enclosing the strands 22 therein. The long axis of the cylinder links 52 are aligned along the string loop, covering the first portion 20S of the string loop 20. The casing 50 encloses the strands 22 therein and prevents the strands 22 of the string loop 20 from separating a sufficient distance to create a strangulation hazard, so that the user with a head and neck cannot place the string loop 20 over the head and around the neck, possibly choking the user. The cylinder link casing 50 covers approximately two-thirds of the associated first portion 20S of the string loop 20. The string loop 20 inside the thru bore of the casing 50 can freely turn to form twists. The cylinder link casing 50 also provides additional amusement when the button spinner 40 spins by creating reverberating noise effects by the links rattling against each other. In one embodiment, the casing 50 covers a second portion 20S of the string loop 20, further preventing the strands 22 of the loop 20 from separating a sufficient distance, creating a strangulation hazard.

Figure 2B:
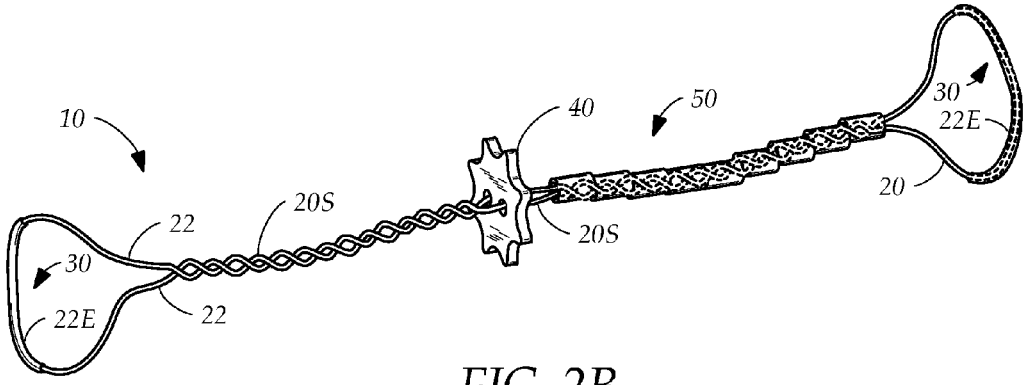
FIG. 2B is a diagrammatic perspective view of the spinning button necklace toy shown with the string loop twisted, the string loop shown in outline inside the cylinder link casing and the handle on the first side and without the casing on the second side.

FIG. 2B shows the spinning button necklace toy 10 with the string loop 20 twisted by rotating the button spinner 40. The portion 20S of the string loop 20 inside the protective casing 50 twists in the same manner as the string loop portion 20S without the casing. The string loop portion 20S is knotless, allowing the string loop 20 to twist without any hinderance on both portions 20S of the string loop 20. In one embodiment, the ends of the strands 22E are connected with a knot that is inside the handle 30, so that the portions 20S of the string loop 20 is essentially knotless, to allow the both portions 20S to freely twist.

As illustrated by the embodiment in FIG. 2A and FIG. 2B, the handles 30 are a pair of tubing segments covering the ends 22E of the strands 22 of the string loop 20 for grasping by the user. When the user is finished playing with the spinning button necklace toy 10, he or she can use a safety fastener or fix the handles 30 together to form a necklace. One of ordinary skill understands that many safety fasteners for necklaces are well known in the art and are beyond this discussion.

Figure 3:
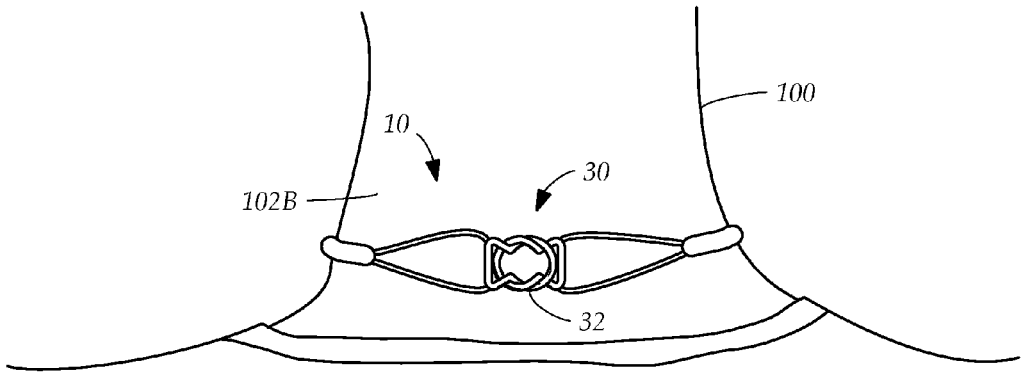
FIG. 3 is a diagrammatic perspective view of a user having a neck with a back, wearing the spinning button necklace toy with a pair of clasp handles closed on the back of the user's neck.
Figure 5:
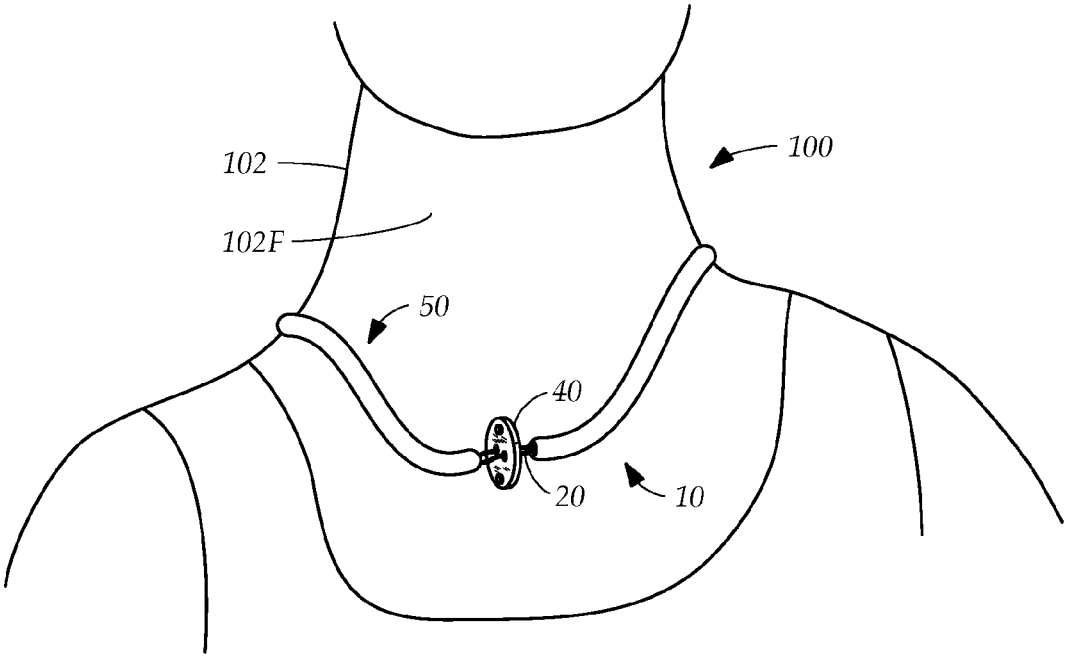
FIG. 5 is a diagrammatic perspective view of a user's neck having a front, wearing the spinning button necklace toy with a button spinner in the front.

FIG. 5 shows the user wearing the spinning button necklace. The user 100, having a neck 102 with a front 102F and back, places the spinning button necklace 10 around the neck 102 with the button spinner 40 on the neck front 102F. The protective casings 50 maintain the length of the spinning button necklace toy 10 by preventing the button spinner 40 from moving significantly along the string loop 20, thereby shortening the length of the necklace 10 and creating a strangulation hazard when placed on the user's neck. FIG. 3 shows the user 100 wearing the spinning button necklace 10 with a pair of handles 30 that forms a two-segment clasp 32 on the back of the neck 102B.

Figure 4:
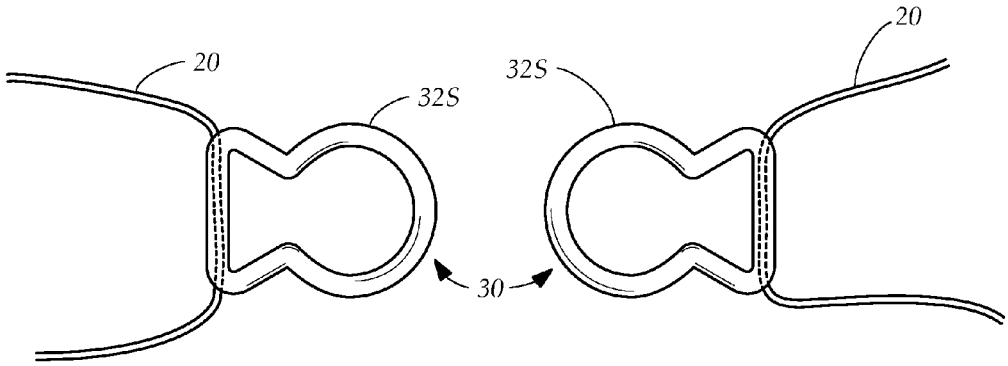
FIG. 4 is a diagrammatic perspective view of the pair of clasp handles open and attached to the string loop.

FIG. 4 shows the pair of handles 30 forming a two-segment clasp, with a pair of segments 32S separated. The string loop 20 goes through the clasp segments 32S, eliminating the need for a knot to attach the clasp segment 32S to the string loop 20. The user grasps the clasp segments 32 to rotate the spinner button and then turns a first segment 32S of the clasp slightly to place the first segment 32S inside a second segment 32S to close the clasp 32S to form the spinning button necklace toy 10 to wear as a necklace as illustrated in FIG. 3.

Figure 1A:
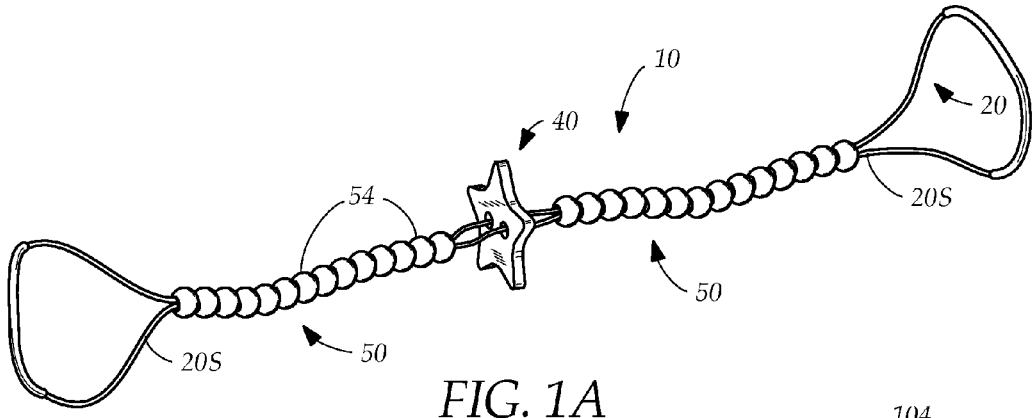
FIG. 1A is a diagrammatic perspective view of a spinning button necklace toy with a pair of bead link casings and a pair of flexible handles.

FIG. 1A shows the spinning button necklace toy 10 with the pair of protective casings 50 formed by a plurality of bead links 54 having a thru bore. The bead links 54 substantially cover two-thirds of each portion 20S of the string loop 20 on each side of the button spinner 40. The string loop 20 inside the bead link casing 50 can freely turn to form twists. The bead link casing 50 also provides additional amusement when the button spinner 40 is spinning by creating additional reverberating noise effects by the links rattling against each other.

Figure 1B:
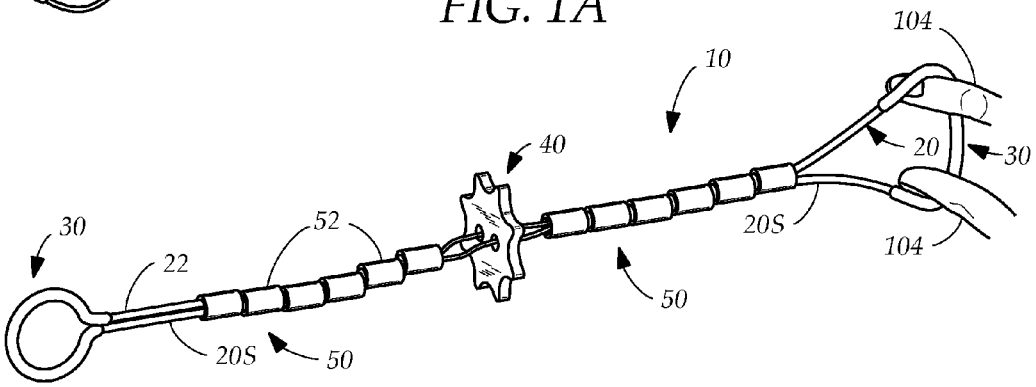
FIG. 1B is a diagrammatic perspective view of the spinning button necklace toy with a pair of cylinder link casings.

FIG. 1B shows the spinning button necklace toy 10 with the pair of protective casings 50 formed by the cylinder links 52. The cylinder links 52 substantially cover two-thirds of each portion 20S of the string loop 20 on each side of the button spinner 40. The handles 30 covering the end of the string loop strands 22 are made from elastomeric material that return to a substantially circular shape. The user, having a plurality of fingers 104, must separate the strands 22 by spreading two fingers 104 inside the handle 30, further maintaining the strands 22 from separating inadvertently and creating the strangulation hazard.

Figure 1C:
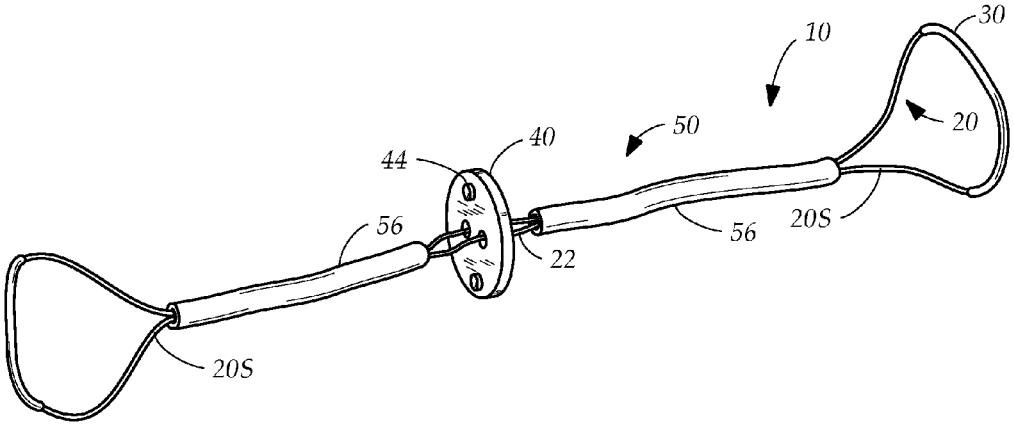
FIG. 1C is a diagrammatic perspective view of the spinning button necklace toy with a pair of tubing link casings.

FIG. 1C shows the spinning button necklace 10 with a pair of protective tubing link casings 50, having a thru bore. The tubing links 56 substantially cover two-thirds of each portion 20S of the string loop 20 on each side of the button spinner 40 allowing sufficient space for the string loop 20 to twist. In this example, the button spinner 40 has a plurality of openings 44 to create a whistling sound when spinning. The tubing links 56 provides an additional sound. The illustrations show multiple examples of casings 50 having a thru bore, that cover two-thirds of each portion 20S of the string loop 20 that prevent the strands 22 from separating and creating the strangulation hazard. It is understood by those of ordinary skill that many variations of protective casings having a thru bore are possible within the inventive concept and the examples are non-limiting.

Referring to FIG. 1B, to use the spinning button necklace as a toy, the user, having a pair of hands, grasps one handle 30 in the fingers 104 of each hand, holding the spinning button necklace toy 10 with the hands forming a horizontal axis and rotates the button spinner 40 around the axis to wind the string loop 20 tightly, creating tension. The user then moves the handles 30 alternatively toward and away from each other, causing the button spinner to spin 40 and the string loop 20 to alternatively wind and unwind until the tension is released. The button spinner stays in place between the portions 20S, the casings 50 keeping the strands 22 together and preventing the button spinner 40 traveling along the horizontal axis. When the user is finished with the toy 10, the user fastens the handles 30 together, placing the necklace 10 around the user's neck, securing it to a backpack or attaching it to clothing as non-limiting examples of methods to store a loop. The necklace 10 cannot expand to fit over a user's head.

In conclusion, herein is presented a safe spinning button necklace with a knotless string loop and a protective casing that eliminates a strangulation hazard. The invention is illustrated by example in the drawing figures, and throughout the written description. It should be understood that numerous variations are possible, while adhering to the inventive concept. Such variations are contemplated as being a part of the present invention.

What is claimed is:

1. A method of using a spinning button necklace toy, comprising:

holding a pair of closed loop handles of a spinning button necklace toy, a handle each in an opposing hand, each handle coupled to opposing ends of a pair of strands of string equal in length, the pair of strands forming a closed string loop having a horizontal axis, the closed string loop having a button spinner, with a pair of holes disposed therethrough, the button spinner rotatably disposed a midpoint on the closed string loop by a first strand of the string loop passing through a first hole of the button spinner and a second strand of the string loop passing through a second hole of the button spinner;

rotating the button spinner around the axis to wind the string loop tightly, creating tension;

moving the handles alternatively toward and away from each other, causing the button spinner to spin and the string loop to alternatively wind and unwind, thereby generating reverberating noise effects from a plurality of discrete hollow bead links, each link having a through bore, the pair of strands disposed therein, the bead links substantially enclosing the strands, the bead links rattling against each other until the tension in the string loop is released; and wearing the toy by fastening the handles together, sliding a first closed loop handle inside a second close loop handle, interlocking the handles together, the handles joining together after placing the spinning button necklace toy on the neck of the user when the user is not spinning the toy.

* * * * *